US007445510B2

(12) United States Patent
Feng et al.

(10) Patent No.: US 7,445,510 B2
(45) Date of Patent: Nov. 4, 2008

(54) SURFACE CONTACT CARD HOLDER

(75) Inventors: An-Ming Feng, Shenzhen (CN); Hsiao-Hua Tu, Tu-cheng (TW); Chia-Hua Chen, Tu-cheng (TW)

(73) Assignees: Shenzhen Futaihong Precision Industry Co., Ltd., ShenZhen, Guangdong Province (CN); Sutech Trading Limited, Tortola (VG)

( * ) Notice: Subject to any disclaimer, the term of this patent is extended or adjusted under 35 U.S.C. 154(b) by 0 days.

(21) Appl. No.: 11/446,550

(22) Filed: Jun. 2, 2006

(65) Prior Publication Data

US 2007/0037431 A1 Feb. 15, 2007

(30) Foreign Application Priority Data

Aug. 12, 2005 (CN) ..... 2005 1 0036579

(51) Int. Cl.
*H01R 24/00* (2006.01)

(52) U.S. Cl. ..... 439/630

(58) Field of Classification Search ..... 439/630, 439/64, 328, 26, 377, 325–326, 159–160; 455/575.1, 55, 90; 361/814, 801, 802
See application file for complete search history.

(56) References Cited

U.S. PATENT DOCUMENTS

| | | | | |
|---|---|---|---|---|
| 5,823,828 | A * | 10/1998 | Bricaud et al. | 439/630 |
| 6,095,868 | A * | 8/2000 | Hyland et al. | 439/630 |
| 6,226,189 | B1 * | 5/2001 | Haffenden et al. | 361/814 |
| 7,125,258 | B2 * | 10/2006 | Nakakubo et al. | 439/64 |
| 2003/0195020 | A1 * | 10/2003 | Kubo | 455/575.1 |
| 2005/0136744 | A1 * | 6/2005 | Kato et al. | 439/630 |

FOREIGN PATENT DOCUMENTS

| | | |
|---|---|---|
| CN | 1288009 A | 9/2000 |
| CN | 1338854 C | 3/2002 |

* cited by examiner

*Primary Examiner*—Edwin A. León

(57) ABSTRACT

A surface contact card holder (100) includes a body (10), a frame (30) and a sliding groove (14). The frame is configured for carrying a surface contact card therein. The sliding groove is provided on the body for receiving the frame. The frame is slidably received in the sliding groove to allow insertion and removal of the surface contact card.

10 Claims, 7 Drawing Sheets

SURFACE CONTACT CARD HOLDER

TECHNICAL FIELD

The present invention generally relates to structures for holding card members in an electronic device and, particularly, to a surface contact card holder for holding a surface contact card in a portable electronic device.

BACKGROUND

With the development of wireless communication and information processing technologies, portable electronic devices such as mobile phones are now in widespread use. These electronic devices enable consumers to enjoy high-tech services anytime and anywhere. Surface contact cards having special circuits are widely used in portable electronic devices to enhance or specialize the functions of the portable electronic devices. For example, a subscriber identity module (SIM) card can be placed in a mobile phone to dedicate the mobile phone' functions to the SIM card owner. By changing SIM cards, a single mobile phone can be used by many different SIM card owners as a personal phone.

Referring now to FIG. 7, a conventional structure for holding a SIM card therein includes a base 42 made of insulating material and a holding structure 44. The base 42 defines a receiving groove 421 and a SIM connector 40 including a plurality of contacts is set in the middle of the receiving groove 421. The shape and size of the receiving groove 421 are the same as those of the SIM card. The holding structure 44 is located adjacent to one end of the receiving groove 421 and can be moved back and forth along the direction as indicated by the arrow shown in FIG. 7.

In use, firstly, the holding structure 44 is moved away from the receiving groove 421 and the SIM card is inserted into the receiving groove 421. Then, the holding structure 44 is moved adjacent to the receiving groove 421 so as to latch the SIM card in the receiving groove 421. In the same way, the SIM card can be released by moving the holding structure 44 away from the receiving groove 421.

In the above conventional structure for holding a SIM card, the holding structure 44 can be easily moved, if a mobile phone employing such a structure for holding a SIM card drops to ground, and shock can easily force the holding structure 44 to move off the receiving groove 421. As a result, the SIM card may not connect well with the SIM contactor or may even become separated from the receiving groove 421. Obviously, such a conventional structure cannot hold the SIM card steadily in the receiving groove 421.

Therefore, there is a need for a new surface contact card holder which can hold a surface contact card steadily in a portable electronic device.

SUMMARY

In one embodiment, a surface contact card holder includes a body, a frame and a sliding groove. The frame is configured for carrying a surface contact card therein. The sliding groove is provided on the body for receiving the frame. The frame is slidably received in the sliding groove allowing insertion and removal of the surface contact card.

Other advantages and novel features of the present embodiment will become more apparent from the following detailed description thereof when taken in conjunction with the accompanying drawings.

BRIEF DESCRIPTION OF THE DRAWINGS

Many aspects of the surface contact card holder can be better understood with reference to the following drawings. The components in the drawings are not necessarily drawn to scale, the emphasis instead being placed upon clearly illustrating the principles of the present surface contact card holder. Moreover, in the drawings, like reference numerals designate corresponding parts throughout the several views.

DETAILED DESCRIPTION OF THE EMBODIMENTS

The present surface contact card holder is suitable for portable electronic devices, such as mobile phones, PDAs, and so on. The surface contact card holder can be used for holding surface contact cards such as SIM cards, compact flash cards (CFs), multimedia cards (MMCs), and so on.

Figure 1:
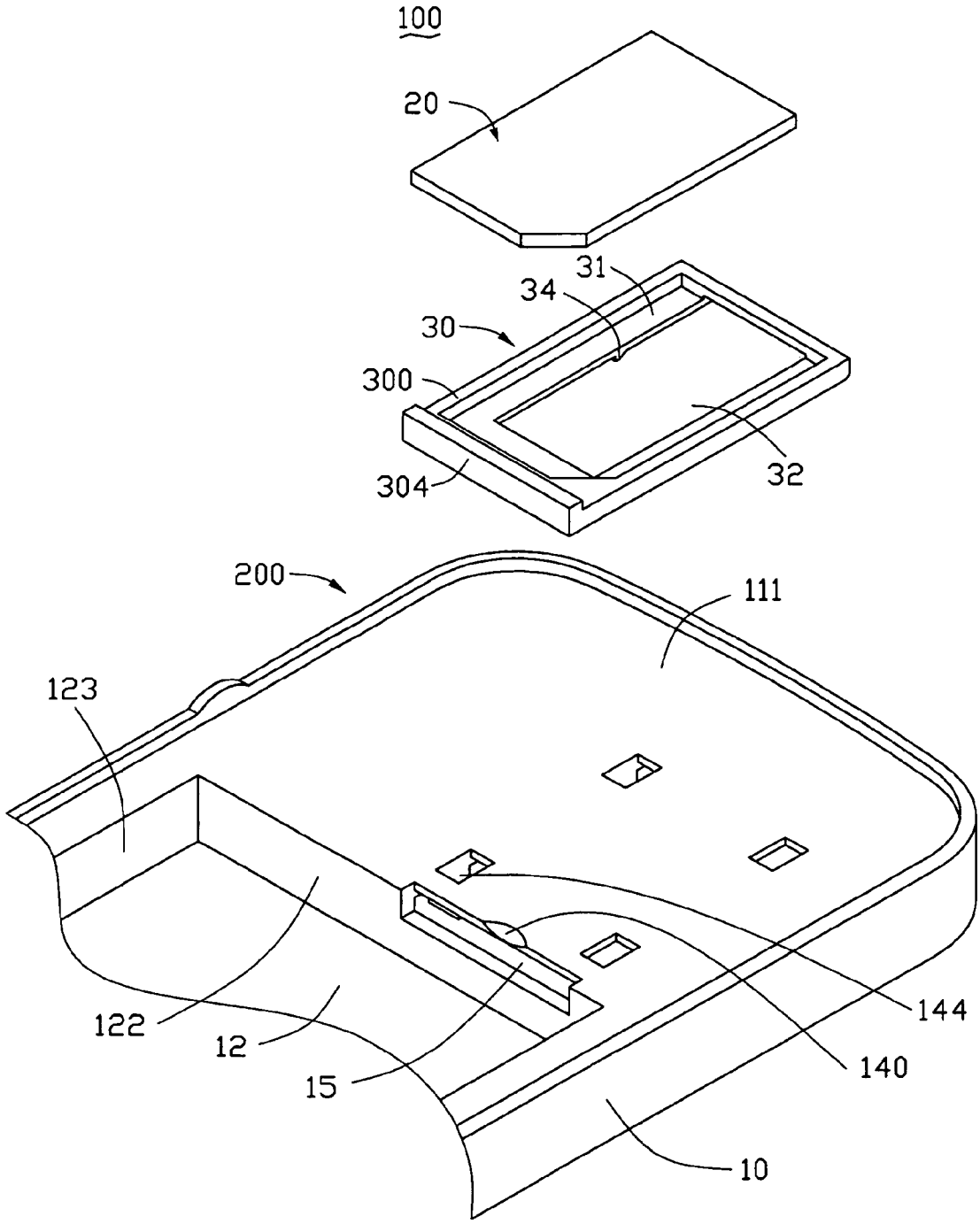
FIG. 1 is an exploded, isometric view of a surface contact card holder with a surface contact card in accordance with a preferred embodiment.
Figure 2:
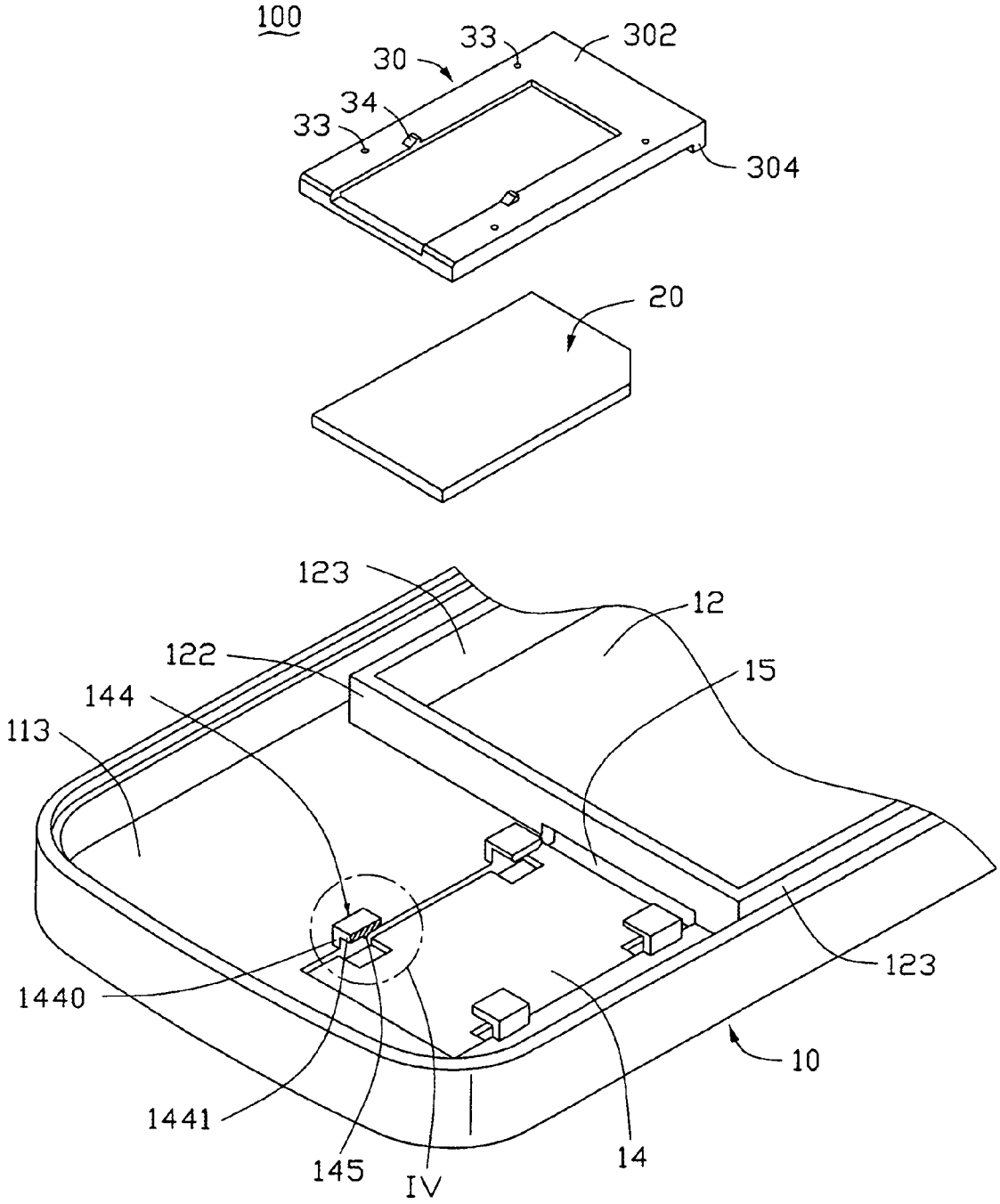
FIG. 2 is similar to FIG. 1 but viewed from another aspect.

Referring now to the drawings in detail, FIG. 1 and FIG. 2 show a surface contact card holder 100 for a SIM card 20 incorporated in a mobile phone/portable electronic device 200. The mobile phone 200 and the SIM card 20 are taken here as an exemplary application for the purposes of describing details of the surface contact holder 100 of the preferred embodiment. The mobile phone 200 includes a main body 10 with a first surface 111 and an opposite second surface 113. A receiving cavity 12 is defined at the main body 10 for receiving a battery (not shown). The receiving cavity 12 communicates with the first surface 111 and the second surface 113, and includes an end wall 122 and two sidewalls 123. One side of the end wall and the sidewalls 123 is substantially coplanar with the first surface 111, the other side of the end wall 122 and the sidewalls 123 extend above the second surface 113.

The surface contact card holder 100 includes a sliding groove 14, a cutout 15, two pairs of latches 144 and a frame 30. The sliding groove 14, the cutout 15 and the latches 144 are formed in the main body 10, adjacent to the receiving cavity 12.

Figure 3:
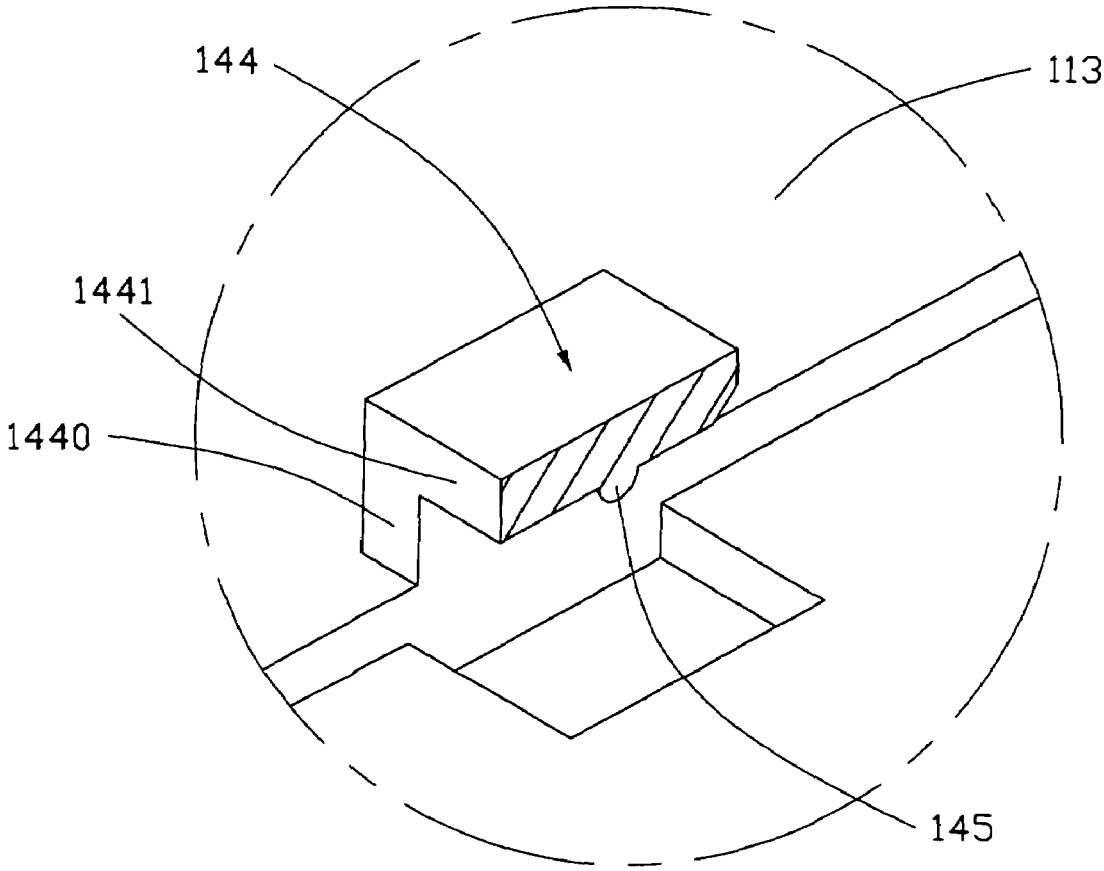
FIG. 3 is enlarged cross-sectional view of the surface contact card holder taken along the area of IV in FIG. 2.

The sliding groove 14 is substantially rectangular in shape, and is formed by recessing the second surface 113 towards the first surface 111. The cutout 15 is defined at the end wall 122, and communicates with the receiving cavity 12. The SIM card 20 enters or exits via the cutout 15. An operation portion 140 is formed at the intersection of the cutout 15 and the first surface 111. The operation portion 140 is substantially a concave surface formed thereat for conveniently operating the frame 130. The two pairs of latches 144 extend from two sides of the sliding groove 14. Each latch 144 includes an extending portion 1441 and a connection portion 1440, together being integrally formed in an L-shape. The connecting portion 1440 and the extending portion 1441 together define a space, and the space and the sliding groove 14 together receive the frame 30. Referring to FIG. 3, the connecting portion 1440 extends directly upwardly from the second surface 113. The extending portion 1441 is parallel with the second surface 113 of the main body 10. A half-sphere projection 145 is formed at one side of the extending portion 1441 toward the second surface 113.

The frame 30 is substantially a rectangular with a top surface 300 and a bottom surface 302. The shape and size of the frame 30 corresponds to the sliding groove 14. The frame 30 includes a flange 304 extending from the top surface 300. A receiving groove 31 is defined at the top surface 300 for receiving the SIM card 20, and the shape and size of the receiving groove 31 corresponds to the SIM card 20. An aperture 32 is defined in the bottom surface 302. The aperture 32 is substantially a central area in the bottom surface 302, and communicates with the receiving groove 31. When the SIM card 20 is received in the receiving groove 31, the SIM card 20 may be electronically connected with a printed circuited board (PCB) of the mobile phone. Opposite to the top surface 300, two pairs of indentations 33 are formed at the bottom surface 302. Each indentation 33 is a half-sphere shape, thereby corresponding to each projection 145 of the latches 144. Two limiting wedge-shaped protrusions 34 are formed at two sides of the aperture 32. Each limiting protrusion 34 is elastic and may be deformable.

Figure 4:
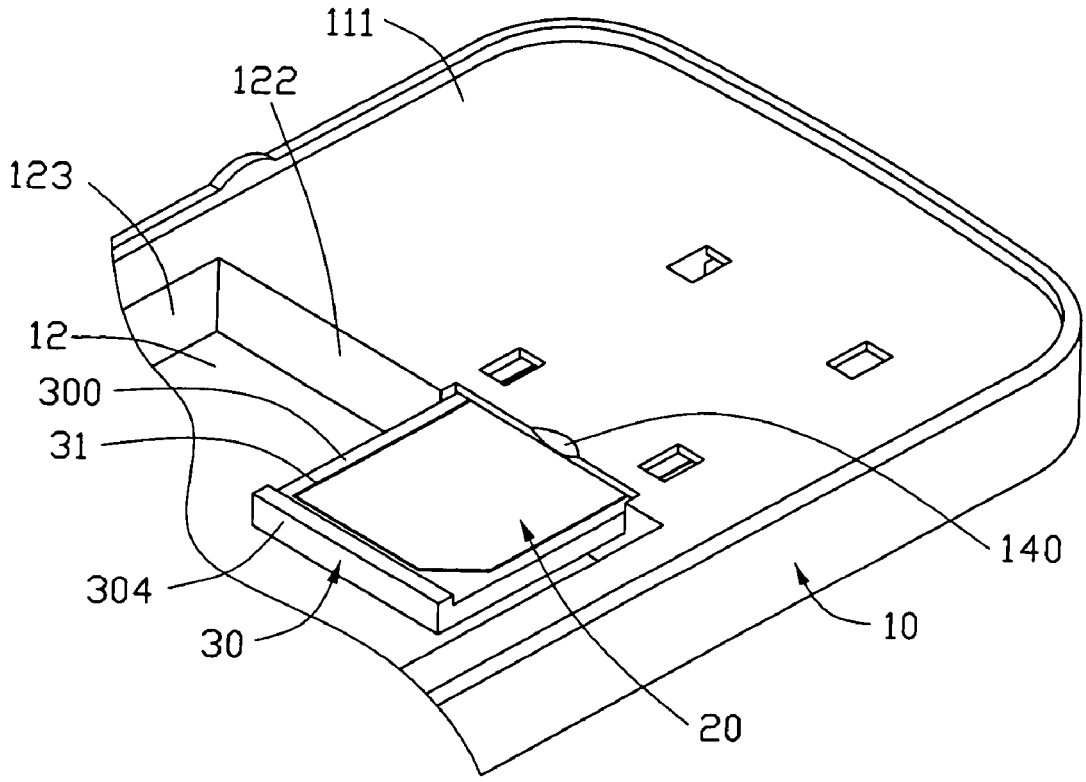
FIG. 4 is an assembled process view of the surface contact card holder with the surface contact card.
Figure 5:
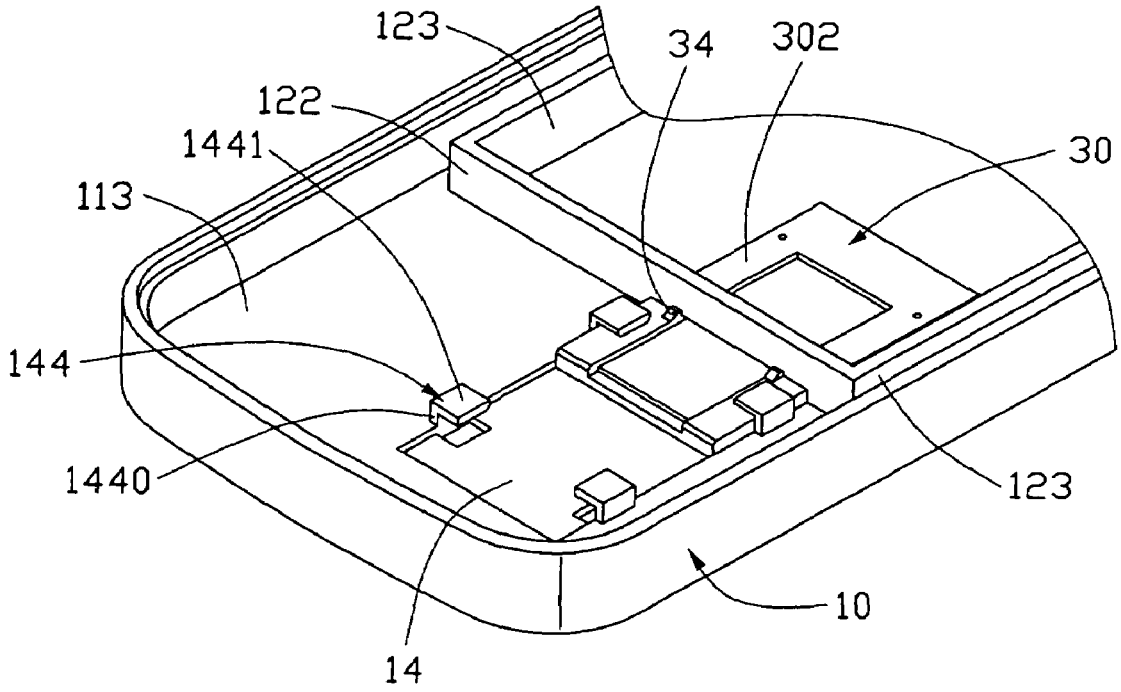
FIG. 5 is similar to FIG. 2, but viewed from another aspect.
Figure 6:
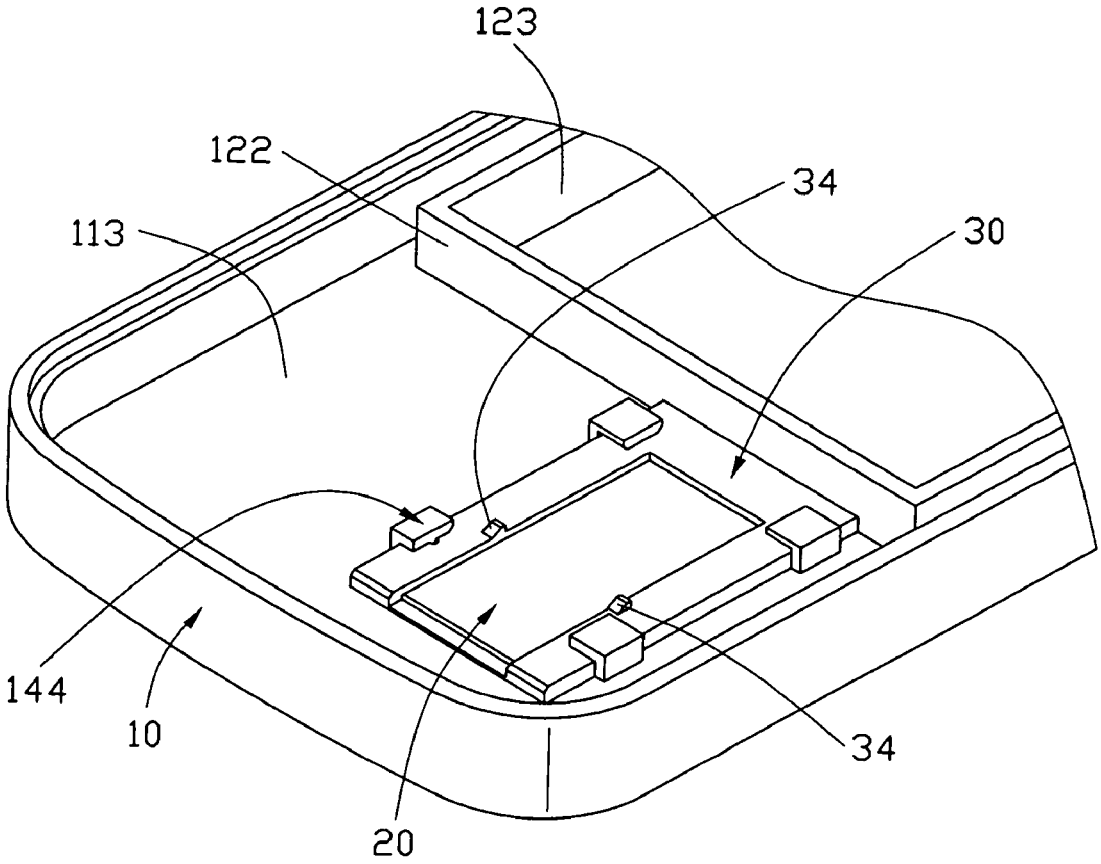
FIG. 6 is an assembled view of the surface contact card holder with the surface contact card.
Figure 7:
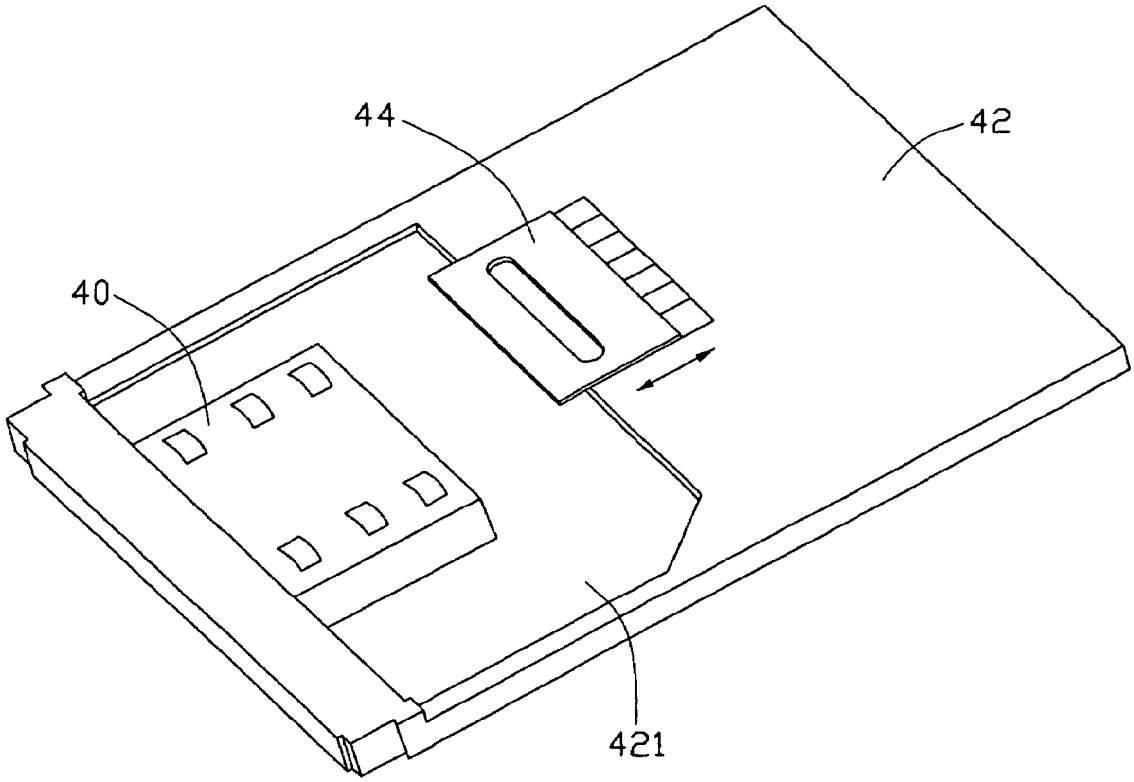
FIG. 7 (RELATED ART)
FIG. 7 is an assembled view of a conventional SIM card holder.

When assembling, referring to FIGS. 4 to 6, one end opposite to the flange 304 of the frame 30 is inserted to the sliding groove 14 from the cutout 15. The user further exerts a force on the frame 30 via the flange 304, such that the frame 30 slides into the sliding groove 14, and resists one pair of latches 144. Then, the limiting protrusions 34 contact with the end wall 122 of the main body 10. Due to the elastic characteristics of the limiting protrusion 34, the limiting protrusion 30 is deformable so that it may pass through the end wall 122. Accordingly, the frame 30 is kept in the sliding groove 14 and cannot break away from the sliding groove 14.

In use, the user draws the flange 304 of the frame 30. After the frame 30 is pulled out until the limiting protrusions 34 resists the end wall 122, the SIM card 20 is partially placed at the receiving groove 31 of the frame 30. Then, the SIM card 20 is further pushed into the receiving groove 31. After that, the user pushes the frame 30 so that the frame 30 is entirely received into the sliding groove 14, with each of projections 145 engaging in a corresponding indentation 33. The SIM card 20 abuts the PCB. The battery (not shown) is received in the cavity 12, with the battery abutting the frame 30. The battery can prevent the frame 30 from becoming separated from the sliding groove 14. Thus, the SIM card 20 is held steadily in the frame 30.

To remove the SIM card 20, the user resists the operation portion 140 of the main body 10, and pulls on the flange 304. Thus, the frame 30 is partially pulled out from the sliding groove 14. Accordingly, the SIM card 20 is taken out from the receiving groove 31.

In alternative embodiments, the sliding groove 14 may be not disposed adjacent to the receiving cavity 12, and is disposed outside of the main body 10. Accordingly, the SIM card 20 may easily be taken out without removing the battery.

In a still further alternative embodiment, the engagement between the projections 145 and the indentations 33 together acts as a locking structure to lock the frame in the receiving groove. Understandably, the locking structure disclosed above may be replaced with other structures. The two limiting protrusions 34 act as a limiting element to avoid the frame 30 being pulled out of the sliding groove 14. Understandably, the limiting element disclosed above may be replaced with other structures.

The frame 30 acts as a sliding element to slide in the body. The sliding groove 14 acts as a receiving portion to contain the sliding element. Understandably, the frame 30 and the sliding groove 14 disclosed above may be replaced with other structures.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

We claim:

1. A surface contact card holder comprising:

a main body;

a frame defining a receiving groove therein, the receiving groove being configured for carrying a surface contact card therein;

a sliding groove recessed in a surface of the main body; and at least two pairs of latches extending above the sliding groove from the main body, each pair of latches being positioned on each side of the sliding groove; each of the latches including an extending portion and a connecting portion, the connecting portion extending directly upwardly from the main body, and the extending portion being parallel to the main body, the connecting portion and the extending portion together defining a space, the space and the sliding groove together receiving the frame;

wherein the frame, together with the surface contact card received thereby, slidably engages in the sliding groove allowing insertion and removal of the surface contact card.

2. The surface contact card holder as claimed in claim 1, wherein at least one projection extending towards the main body is formed on the extending portion, at least one indentation is defined by a bottom surface of the frame, and the at least one the projection engages in the at least one indentation.

3. The surface contact card holder as claimed in claim 1, wherein the frame includes a top surface and a bottom surface, at least one indentation is formed at the bottom surface of the frame, at least one latch is provided with a projection, and the projection engages in the at least one indentation.

4. The surface contact card holder as claimed in claim 1, wherein a concave surface is formed on the main body and is disposed at one end of the sliding groove for conveniently operating the frame.

5. The surface contact card holder as claimed in claim 1, wherein the frame further defines an aperture, the aperture allows the surface contact card to be electrically connected to a printed circuited board.

6. The surface contact card holder as claimed in claim 1, wherein the receiving groove has a size and shape corresponding to that of the surface contact card.

7. A holder for holding a surface contact card in a portable electronic device having a device body, the holder comprising:

a frame being configured for receiving the surface contact card, the frame including a top surface and a bottom surface, the bottom surface defining an aperture in a central area thereof two wedge limiting protrusions being formed on the bottom surface of the frame, and positioned two sides of the aperture;

a receiving portion recessed in the device body, the receiving portion being configured for receiving and holding the frame therein, two wedge limiting protrusions preventing the frame from becoming separated from the receiving portion;

at least two pairs of latches extending above the receiving portion from the device body, each pair of latches being respectively symmetrically positioned at two sides of the receiving portion; and a locking structure;

wherein the frame is slidable relative to the receiving portion so as to allow the insertion and removal of the surface contact card, and the locking structure serves to keep the frame in the receiving portion.

8. The holder as claimed in claim 7, wherein a concave surface is formed on the device body and is disposed at one end of the receiving portion for conveniently operating the sliding element.

9. The holder as claimed in claim 7, wherein each of the latches includes an extending portion and a connection portion, the connecting portion extending directly upwardly from the body, and the extending portion being parallel to the main body.

10. The holder as claimed in claim 9, wherein at least one projection extending towards the device body is formed on the extending portion, at least one indentation is defined by the frame, and the at least one projection engages in the at least one indentation.

* * * * *